US005461832A

United States Patent [19]

Smith

[11] Patent Number: 5,461,832

[45] Date of Patent: Oct. 31, 1995

[54] TRANSPORTABLE FOLDABLE BUILDING AND METHOD OF ERECTING A TRANSPORTABLE FOLDABLE BUILDING

[76] Inventor: Gene A. Smith, 146 Wall Street On The Water, Shallotte, N.C. 28459

[21] Appl. No.: 239,703

[22] Filed: May 9, 1994

[51] Int. Cl.[6] ..... E04B 1/344

[52] U.S. Cl. ..... 52/69; 52/71; 52/143

[58] Field of Search ..... 52/64, 66, 69, 52/71, 143

[56] References Cited

U.S. PATENT DOCUMENTS

| | | | |
|---|---|---|---|
| 2,145,353 | 1/1939 | Holmes | 52/69 |
| 2,155,876 | 4/1939 | Stout | 52/69 |
| 2,325,747 | 8/1943 | Dailey | 52/71 |
| 2,482,918 | 9/1949 | Kump, Jr. | 52/64 |
| 2,765,499 | 10/1956 | Couse | 52/66 |
| 2,895,256 | 7/1959 | Miller | 52/66 |
| 3,160,434 | 12/1964 | Hedgepeth | 52/64 |
| 3,968,618 | 7/1976 | Johnson | 52/69 |
| 4,045,926 | 9/1977 | Gibbs | 52/143 |
| 4,232,488 | 11/1980 | Hanley | 52/71 |
| 4,780,996 | 11/1988 | Julien, Jr. | 52/68 |
| 4,912,891 | 4/1990 | Bertrand | 52/71 |
| 5,107,639 | 4/1992 | Morin et al. | 52/71 |
| 5,159,790 | 11/1992 | Harding | 52/86 |

FOREIGN PATENT DOCUMENTS

| | | | |
|---|---|---|---|
| 2312610 | 12/1976 | France | 52/71 |
| 1598882 | 10/1990 | U.S.S.R. | 52/66 |
| 1439252 | 6/1976 | United Kingdom | 52/69 |

*Primary Examiner*—Carl D. Friedman
*Assistant Examiner*—Laura A. Saladino
*Attorney, Agent, or Firm*—W. Thad Adams, III

[57] ABSTRACT

The invention is a transportable foldable building for being mounted on a supporting foundation, and method of erecting a transportable foldable building. The building includes a central roof section, first and second outer roof sections, and first and second side walls. The central roof section is supported in vertically spaced relation above the foundation. The first and second outer roof sections are pivotally attached to opposing edges of the central roof section, and extending downwardly from the central roof section during transport of the building to reduce the width of the building. The first side wall is pivotally attached to the first outer roof section for being folded in overlying relation to the first outer roof section during transport of the building. The second side wall is pivotally attached to the second outer roof section for being folded in overlying relation to the second outer roof section during transport of the building.

23 Claims, 15 Drawing Sheets

TRANSPORTABLE FOLDABLE BUILDING AND METHOD OF ERECTING A TRANSPORTABLE FOLDABLE BUILDING

TECHNICAL FIELD AND BACKGROUND OF THE INVENTION

This invention relates to a transportable, foldable building, and method of erecting a transportable, foldable building. The building is first assembled at a prefabrication site, and mounted in a folded condition onto a vehicle for transporting the building to a building erection site. At the erection site, the building is unfolded and mounted on a pre-formed supporting foundation. The present invention may be used for permanent or temporary storage, as an emergency shelter, as an airplane hanger, for military purposes, and other related applications.

Foldable or collapsible buildings are generally known in the art, and suffer from many drawbacks and disadvantages. A primary drawback is the limited transportability of such buildings, and the time and effort required to assemble and mount the building onto the supporting foundation. Typically, customized tools or lifting devices must be used to unfold the walls and floor of the building. Once erected, further assembly and construction is often required.

The present invention eliminates many of the problems of prior art foldable building structures by providing a building which is relatively light-weight, and easily transported from one location to another. The present building is easy to erect and assemble without the use of customized lifting devices or special tools. In addition, the invention may be constructed according to any desired dimensions.

SUMMARY OF THE INVENTION

Therefore, it is an object of the invention to provide a foldable building which is relatively easy to transport.

It is another object of the invention to provide a foldable building which is relatively easy to assemble.

It is another object of the invention to provide a foldable building which is relatively easy to disassemble and move to a new location.

It is another object of the invention to provide a foldable building which transported and erected using an erection trailer and vehicle.

It is another object of the invention to provide a foldable building which is mounted on a pre-formed concrete foundation.

It is another object of the invention to provide a foldable building which includes siding and insulation affixed to the walls of the building at a prefabrication site, prior to folding and transporting the building to a building erection site.

It is another object of the invention to provide a foldable building which is relatively inexpensive to construct.

These and other objects of the present invention are achieved in the preferred embodiments disclosed below by providing a transportable, foldable building for being mounted on a supporting foundation. The building includes a central roof section, first and second outer roof sections, and first and second side walls. The central roof section is supported in vertically spaced relation above the foundation. The first and second outer roof sections are pivotally attached to opposing edges of the central roof section, and extending downwardly from the central roof section during transport of the building to reduce the width of the building. The first side wall is pivotally attached to the first outer roof section for being folded in overlying relation to the first outer roof section during transport of the building. The second side wall is pivotally attached to the second outer roof section for being folded in overlying relation to the second outer roof section during transport of the building.

The building is erected onto the supporting foundation by vertically lifting and securing the first and second outer roof sections into alignment with the central roof section. The first and second side walls are then unfolded downwardly from respective first and second outer roof sections to the supporting foundation.

According to one preferred embodiment of the invention, the central roof section includes first and second, opposing central roof beams laterally spaced-apart and located respectively at front and back ends of the roof of the building.

According to another preferred embodiment of the invention, the first and second outer roof sections include respective pairs of opposing outer roof beams pivotally attached to the first and second central roof beams of the central roof section. The pairs of outer roof beams extend downwardly from the first and second central roof beams during transport of the building and prior to erecting the building onto the supporting foundation.

According to yet another preferred embodiment of the invention, the building includes respective hinge assemblies for pivotally attaching the pairs of outer roof beams of the first and second outer roof sections to the central roof beams of the central roof section.

Preferably, each of the hinge assemblies includes coupling means for securing the outer roof beams of the first and second outer roof sections and the central roof beams of the central roof section to each other in an immovable condition to thereby define a rigid, fixed roof frame.

Preferably, the coupling means are complementary pairs of threaded bolts and nuts.

According to one preferred embodiment of the invention, a plurality of horizontal joists are interposed between the central roof beams of the central roof section and the pairs of outer roof beams of the first and second outer roof sections for supporting insulation and exterior siding.

According to another preferred embodiment of the invention, the first and second side walls include respective pairs of opposing side beams pivotally attached to the pairs of outer roof beams of the first and second outer roof sections. The pairs of side beams are folded inwardly in overlying relation to the pairs of outer roof beams during transport of the building and prior to erecting the building onto the supporting foundation.

According to yet another preferred embodiment of the invention, the building includes respective hinge assemblies for pivotally attaching the pairs of side beams of the first and second side walls to the pairs of outer roofs of the first and second outer roof sections.

Preferably, each of the hinge assemblies includes coupling means for securing the side beams of the first and second side walls and the outer roof beams of the first and second outer roof sections to each other in an immovable condition to thereby define opposing side wall frames for providing vertical support when the building is erected onto the foundation.

Preferably, the coupling means are complementary pairs of threaded bolts and nuts.

According to one preferred embodiment of the invention, the building includes a plurality of horizontal joists interposed between respective pairs of side beams of the first and second side walls for supporting insulation and exterior siding.

According to another preferred embodiment of the invention, the building includes front and back walls for being attached to the building after the building is erected onto the supporting foundation.

According to yet another preferred embodiment of the invention, the front and back walls each include a connecting extension for mating with a complementary sleeve formed on respective front and back ends of the roof to connect the front wall to a front end of the building and the back wall to a back end of the building.

Preferably, the supporting foundation is a flat concrete slab.

A further embodiment of the invention includes a transportable foldable building to be mounted on a supporting foundation. The building includes a central roof section, first and second outer roof sections, third and fourth outer roof sections, and first and second side walls. The central roof section is supported in vertically spaced relation above the foundation. The first and second outer roof sections are pivotally attached to opposing edges of the central roof section, and extending downwardly from the central roof section during transport of the building to reduce the width of the building.

The third and fourth outer roof sections are pivotally attached, respectively, to the first and second outer roof sections. The third and fourth outer roof sections are folded inwardly to reduce the width of the building during transport and prior to erecting.

The first and second side walls are pivotally attached, respectively, to the third and fourth outer roof sections. The first and second side walls are folded in overlying relation to the third and fourth outer roof sections during transport of the building and prior to erecting.

A building transport and erection assembly is preferably used in combination with a transportable foldable building. The building transport and erection assembly includes a trailer and carriage. The trailer moves along a supporting surface to transport the building in a folded condition from a building prefabrication site to a building erection site. The carriage is mounted on the trailer in vertically spaced relation above the supporting surface for carrying and supporting the building during transport, and prior to erecting the building onto the foundation.

According to one preferred embodiment of the invention, the building transport and erection assembly further includes at least one adjustable jack. The jacks are mounted on the trailer and interposed between the carriage and the trailer for vertically adjusting the height of the carriage to lift or lower the building prior to erecting the building onto the foundation.

According to another preferred embodiment of the invention, the building transport and erection assembly further includes a lifting arm for being removably attached to the trailer to lift the outer roof sections of the building during erection of the building onto the foundation.

Preferably, the lifting arm includes a hoist cable and winch.

A method of erecting a foldable building onto a supporting foundation, according to one embodiment of the invention, includes the steps of locating a central roof section in vertically spaced relation above the supporting foundation. The first and second outer roof sections are then lifted from a lowered position to a raised position into alignment with the central roof section to define a roof of the building. The first and second side walls are then pivoted downwardly from a position adjacent the first and second outer roof sections to the supporting foundation.

According to one preferred embodiment of the method, the step of locating the central roof section above the foundation includes the step of providing a trailer and carriage for supporting the building prior to and during erecting onto the supporting foundation.

According to another preferred embodiment of the method, the step of locating the central roof section above the foundation further includes the step of providing a least one adjustable jack mounted on the trailer and interposed between the trailer and the carriage for vertically adjusting the height of the carriage to lift or lower the building prior to erecting the building onto the foundation.

According to yet another preferred embodiment of the method, the step of lifting the first and second outer roof sections includes the step of attaching a lifting arm to the trailer for individually lifting each of the first and second outer roof sections into alignment with the central roof section.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
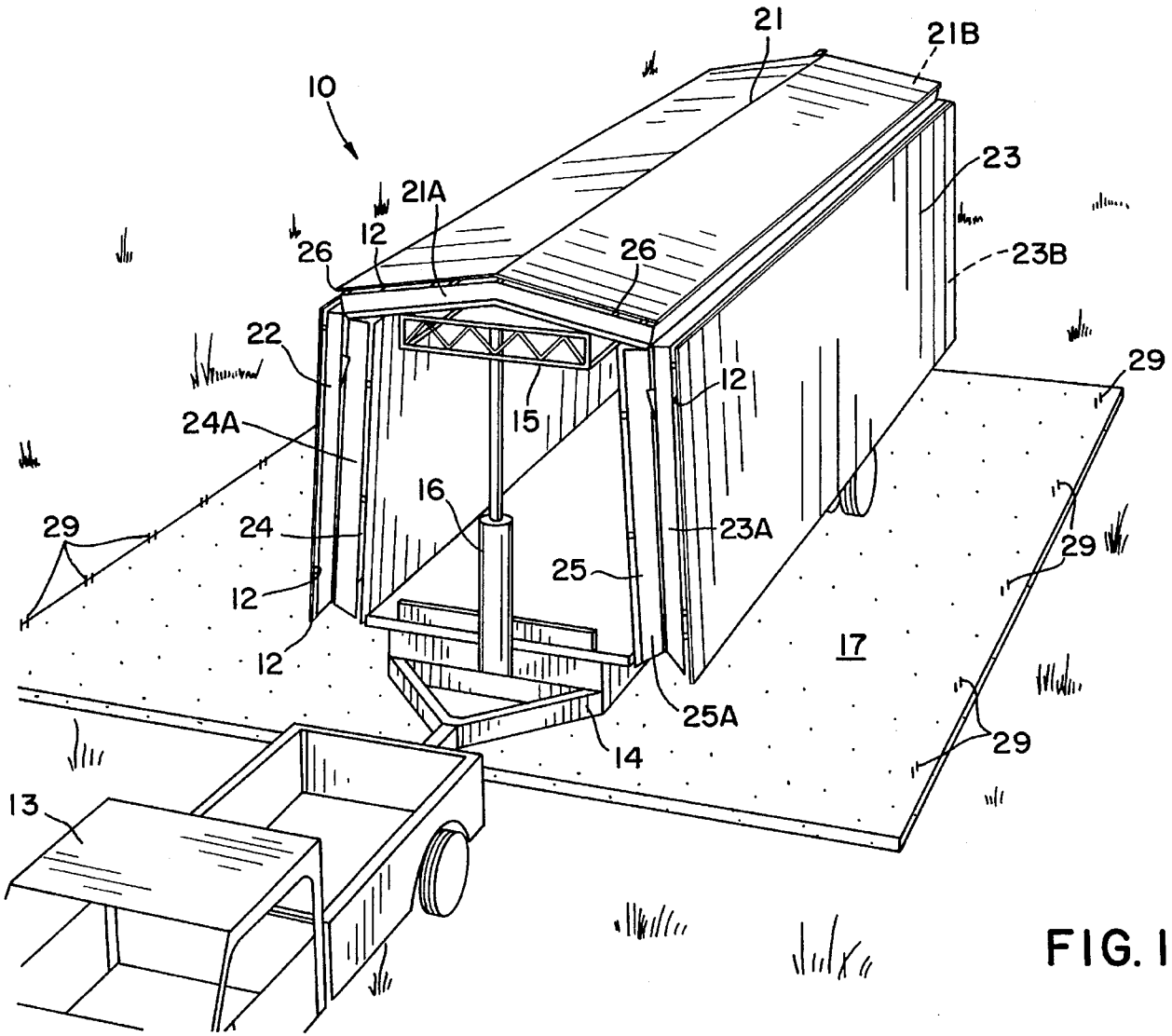
FIG. 1 is an environmental perspective view of a foldable building, according to one embodiment of the invention, shown in a folded condition prior to mounting on the concrete foundation.

Referring now specifically to the drawings, a foldable building according to the present invention is illustrated in FIG. 1 and shown generally at reference numeral 10. The building 10 preferably includes insulation 11 and exterior siding 12 (See FIGS. 5 and 6) which is affixed to the building 10 at a prefabrication site. From the prefabrication site, the assembled building 10 is transported in a folded condition to a building erection site. Preferably, a vehicle 13 including a flatbed trailer 14 and carriage 15 is used for transporting the folded building 10. The carriage 15 is vertically moveable by operation jacks 16 carried on opposite ends of the trailer 14. After arriving at the building erection site, the building 10 is unfolded and mounted on a pre-formed concrete foundation 17, as described in detail below.

General Description of Building 10

The building 10, shown in FIGS. 1–13, is constructed of a central roof section 21, first and second outer roof sections 22 and 23, and first and second side walls 24 and 25. The central roof section 21 includes spaced-apart, opposing central roof beams 21A and 21B at opposite ends of the building 10 which are vertically supported by the carriage 15 during transport of the building 10, and prior to unfolding and mounting the building 10 on the concrete foundation 17. The first and second outer roof sections 22 and 23 include respective pairs of spaced-apart outer roof beams, 22A, 22B and 23A, 23B, pivotally connected to the beams 21A and 21B of the central roof section 21. The first and second side walls 24 and 25 include respective pairs of side beams, 24A, 24B and 25A, 25B, pivotally connected to the beams 22A, 22B and 23A, 23B of the first and second outer roof sections 22 and 23.

Each of the corresponding, opposing beams 21A&21B, 22A&22B, 23A&23B, 24A&24B, and 25A&25B of the building 10 are interconnected by a plurality of horizontal joists 26 (See FIG. 13) for carrying the building insulation 11 and exterior siding 12. As is well known by those of skill in the art, buildings of greater dimensions will require additional beams and joists to provide the necessary lateral and vertical support for the building. According to one embodiment, the building 10 has dimensions of 24 ft.×24 ft. Alternatively, the building 10 may have dimensions such as 24 ft.×36 ft., 30 ft.×36 ft., or 50 ft.×50 ft.

A hinge assembly 28, 38 (See FIGS. 5 and 6) is located between each of the adjacent beams 21A&21B, 22A&22B, 23A&23B, 24A&24B, and 25A&25B of the building 10 to pivotally connect the beams together. The respective hinge assemblies 28, 38 permit the walls of the building 10 to fold inwardly during transport, and to unfold outwardly for mounting the building 10 onto the concrete foundation 17.

Transporting the Building 10

As discussed above, the building 10 is preferably fully assembled at a prefabrication site where exterior siding 12 and insulation 11 is applied to the walls of the building 10. The completed building 10 is then mounted on the trailer 14 and carriage 15, and folded for transport to the building erection site. Folding the building 10 prior to transport permits relatively easy relocation of buildings of relatively large dimensions, such as 50 ft.×50 ft. buildings.

The jacks 16 mounted on the trailer 14 allow vertical adjustment of the position of the carriage 15 relative to the trailer 14. This permits the carriage 15 to lift or lower the building 10, as desired. Preferably, the jacks 16 are standard railroad jacks. Alternatively, the jacks 16 may be heavy-duty hydraulically actuated cylinders.

When the building 10 is ready for transport, the jacks 16 and carriage 15 elevate the folded building 10 a sufficient distance above the ground. The trailer 14 is then attached to vehicle 13 which transports the folded building 10 to the building erection site. At the erection site, the folded building 10 is centered on the concrete foundation 17, and the trailer 14 detached from the vehicle 13.

Erecting the Building 10

Figure 2:
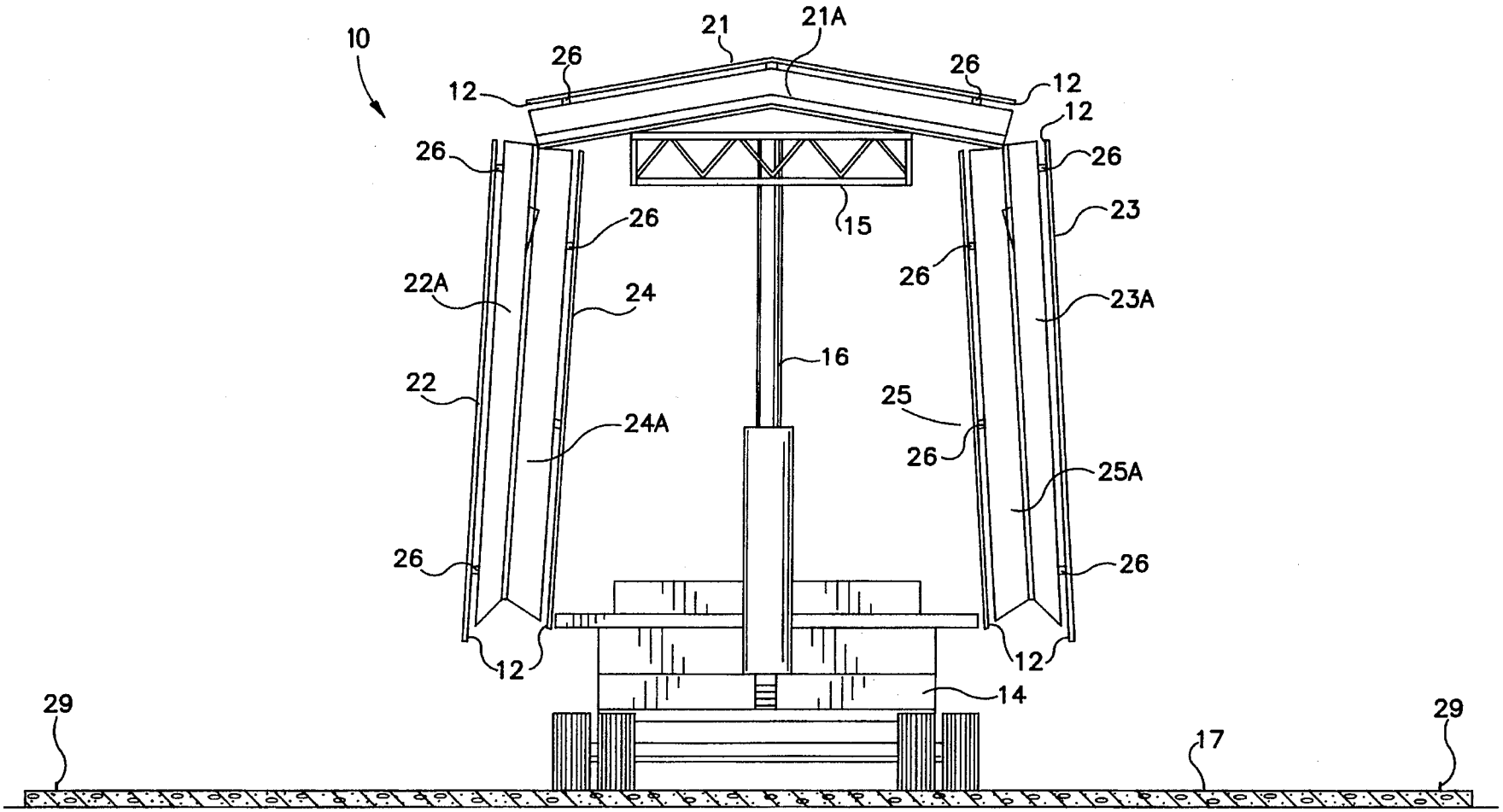
FIG. 2 is a front elevation of the foldable building of FIG. 1 in a folded condition prior to mounting on the concrete foundation.
Figure 3:
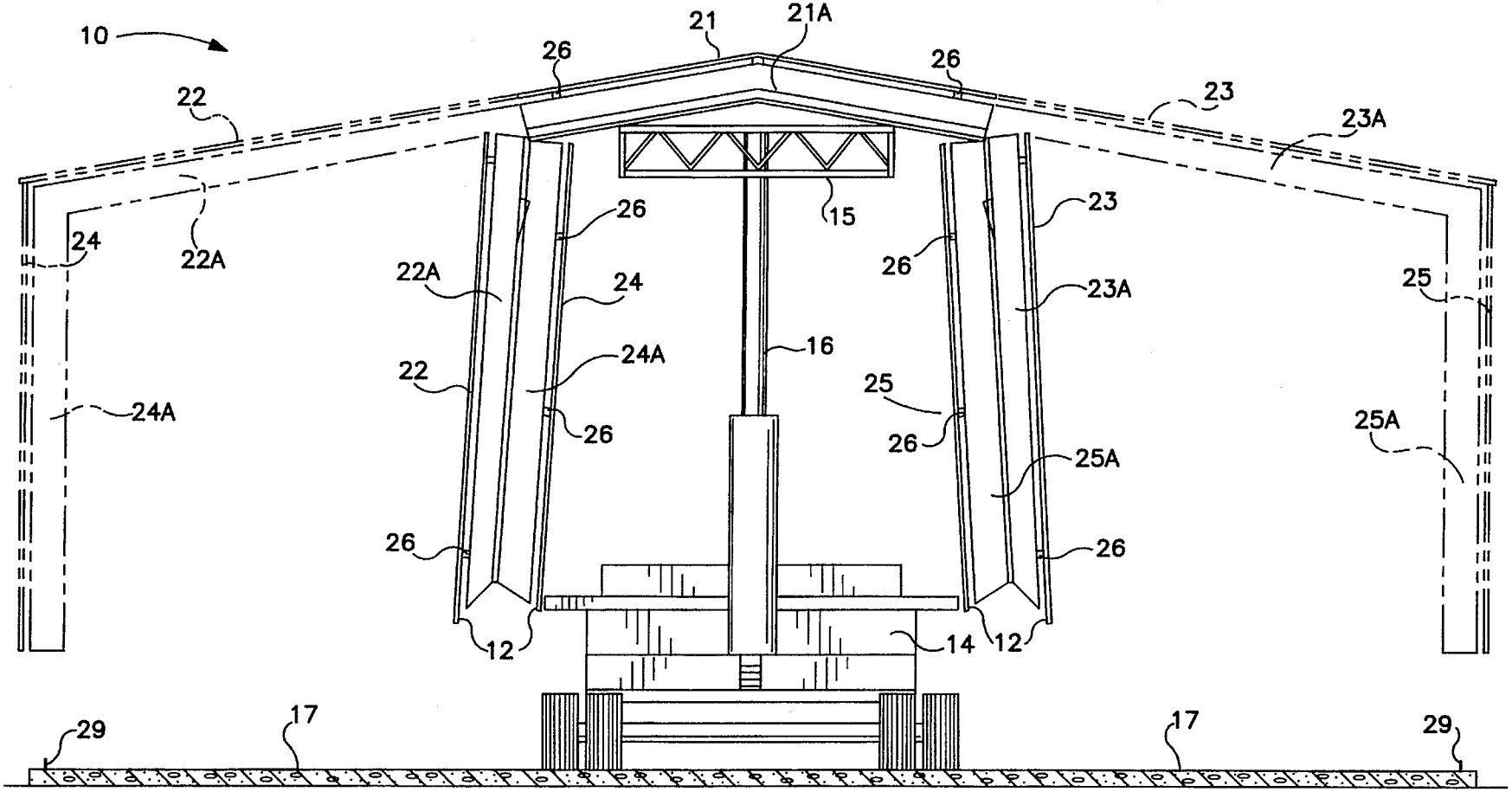
FIG. 3 is a front elevation of the foldable building illustrated in FIG. 2, and further showing in phantom the position of the walls of building when erected.

FIGS. 2 and 3 best illustrate the arrangement of the central roof section 21, outer roof sections 22 and 23, and side walls 24 and 25 prior to unfolding and mounting the building 10 on the concrete foundation 17. The carriage 15 of the trailer 14 supports the building 10 above the concrete foundation 17 prior to and during unfolding.

As shown in phantom in FIG. 3, the central roof section 21 and outer roof sections 22 and 23 collectively define the roof "R" of the building 10. The side walls 24 and 25 extend downwardly from the roof "R" to the concrete foundation 17. Brackets (not shown) located along the base of the side walls 24 and 25 align and mate with a plurality of anchor pins 29 extending upwardly from the concrete foundation 17. The anchor pins 29 serve to secure the building 10 to the foundation 17.

Figure 4:
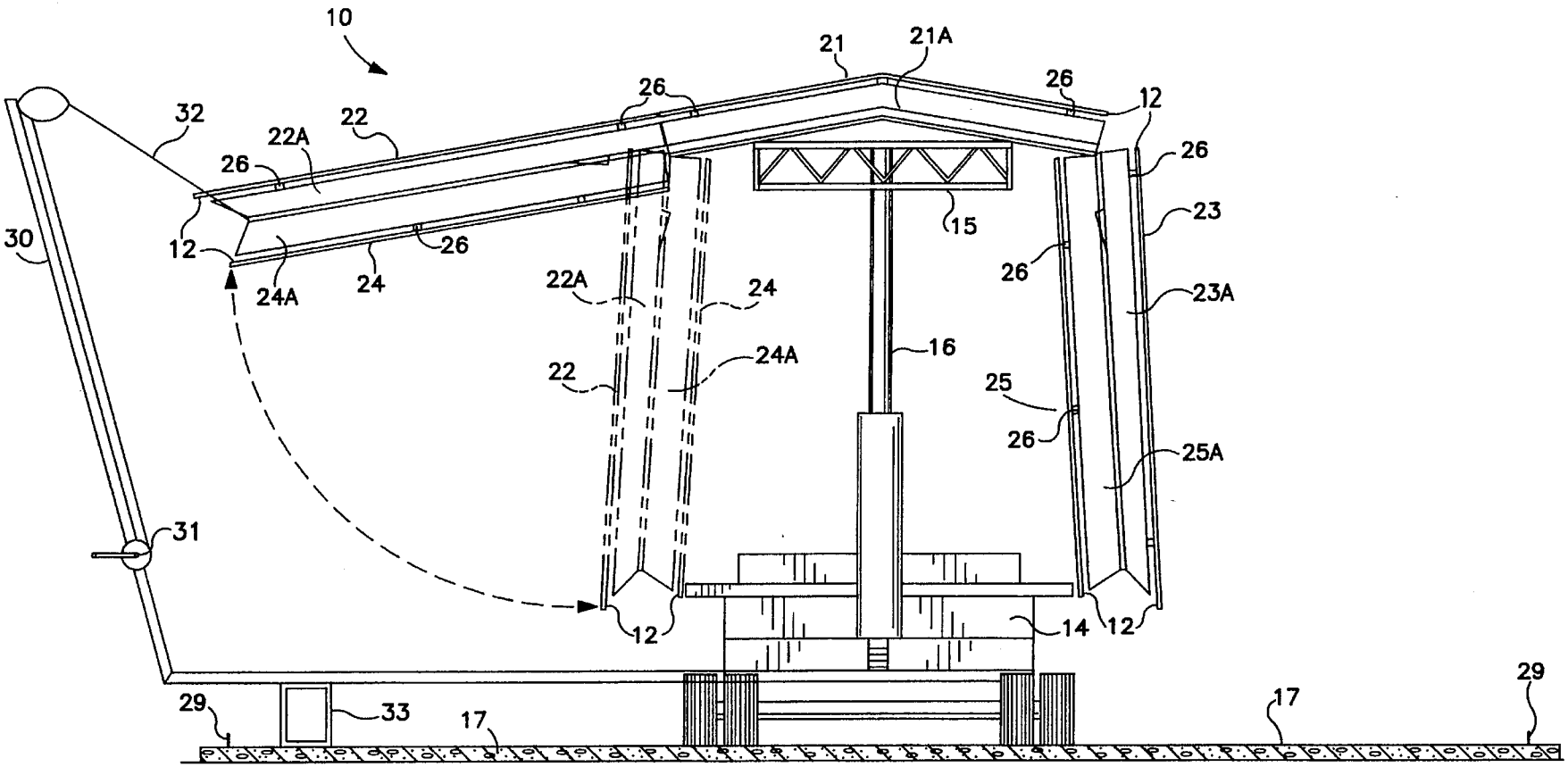
FIG. 4 is a front elevation of the foldable building showing the first outer roof section lifted into position in substantial alignment with the central roof section.

To erect the building 10, a lifting arm 30 including a winch 31 and hoist cable 32 is preferably used to lift each of the outer roof sections 22 and 23 into alignment with the central roof section 21. The lifting arm 30 is removable from the trailer 14, and is preferably stored in the trailer 14 for convenient and easy access. The trailer 14 includes channel brackets (not shown) located on opposing sides of the trailer 14 for receiving the connecting end of the lifting arm 30. A block 33 provides vertical support for the lifting arm 30 as the respective walls of the building 10 are moved into their erected position. As shown in FIG. 4, the hoist cable 32 is first attached to an edge of the first outer roof section 22, and is then retracted using the winch 31 to lift the first outer roof section 22 into position.

FIG. 4 illustrates the pivoting movement of the first outer roof section 22 from the lowered position to the raised position in substantial alignment with the central roof section 21. When properly aligned, the outer roof beams 22A and 22B of the first outer roof section 22 are coupled, respectively, with the central roof beams 21A and 21B of the central roof section 21 by a plurality of threaded bolts and nuts. Alternatively, the respective outer roof beams 22A and 22B and central roof beams 21A and 21B may be connected together by welding.

Figure 5:
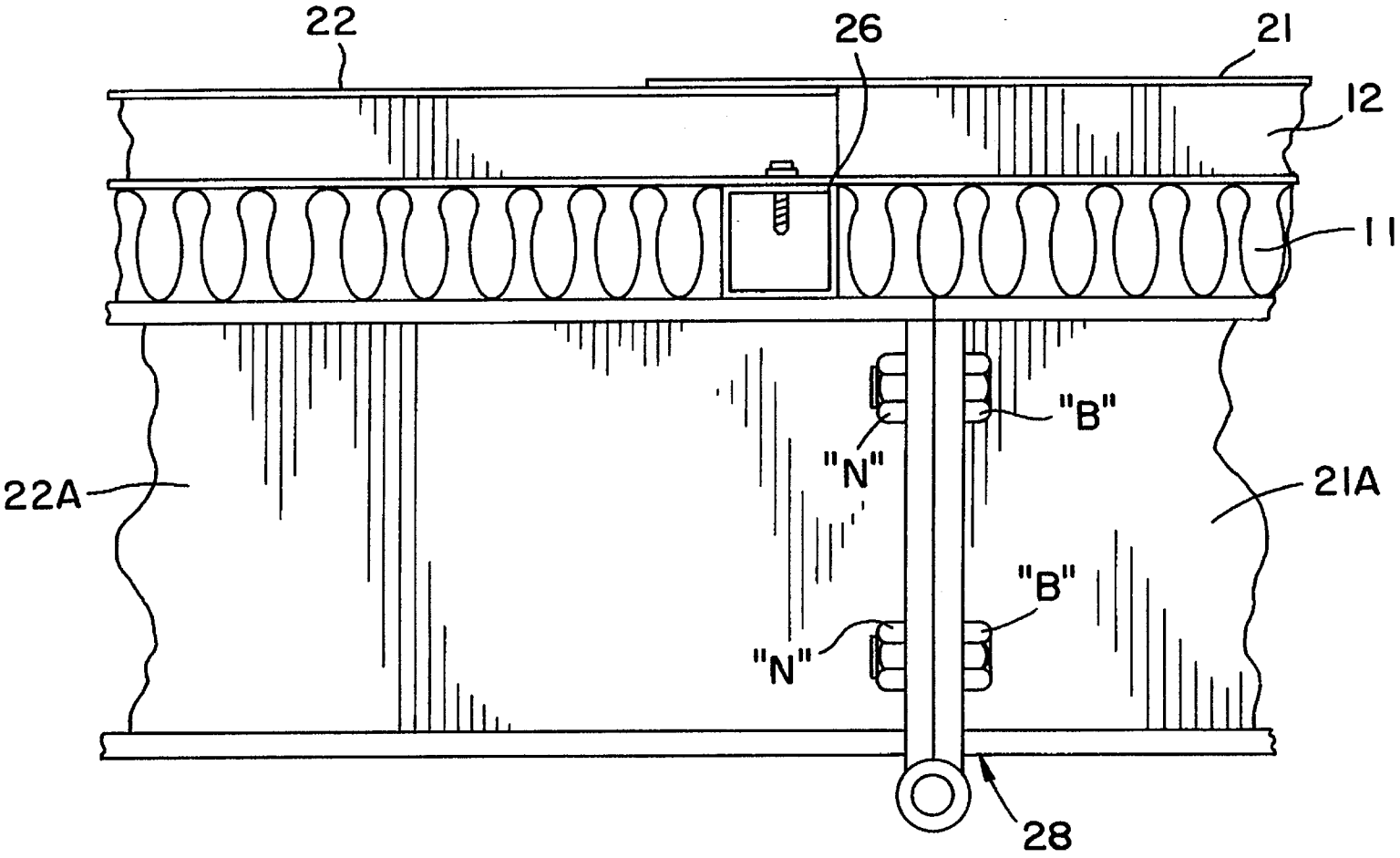
FIG. 5 is an enlarged, fragmentary view of an outer roof beam and an adjacent central roof beam, showing particularly the hinge assembly and connection between the two beams.

The connection of a single outer roof beam 22A to an adjacent central roof beam 21A is best shown in FIG. 5. The hinge assembly 28 and connection of the remaining outer roof beams 22A, 22B, 23A, and 23B to the central roof beams 21A and 21B are identical to that shown in FIG. 5.

Once the first outer roof section 22 has been secured in the raised position to the central roof section 21 as described above, the first side wall 24 is lowered and secured to the first outer roof section 22. The side beams 24A and 24B of the first side wall 24 and the outer roof beams 22A and 22B of the first outer roof section 22 are connected together, respectively, by a plurality of threaded bolts "B" and nuts "N". Alternatively, the respective side beams 24A and 24B and outer roof beams 22A and 22B may be connected together by welding.

Figure 6:
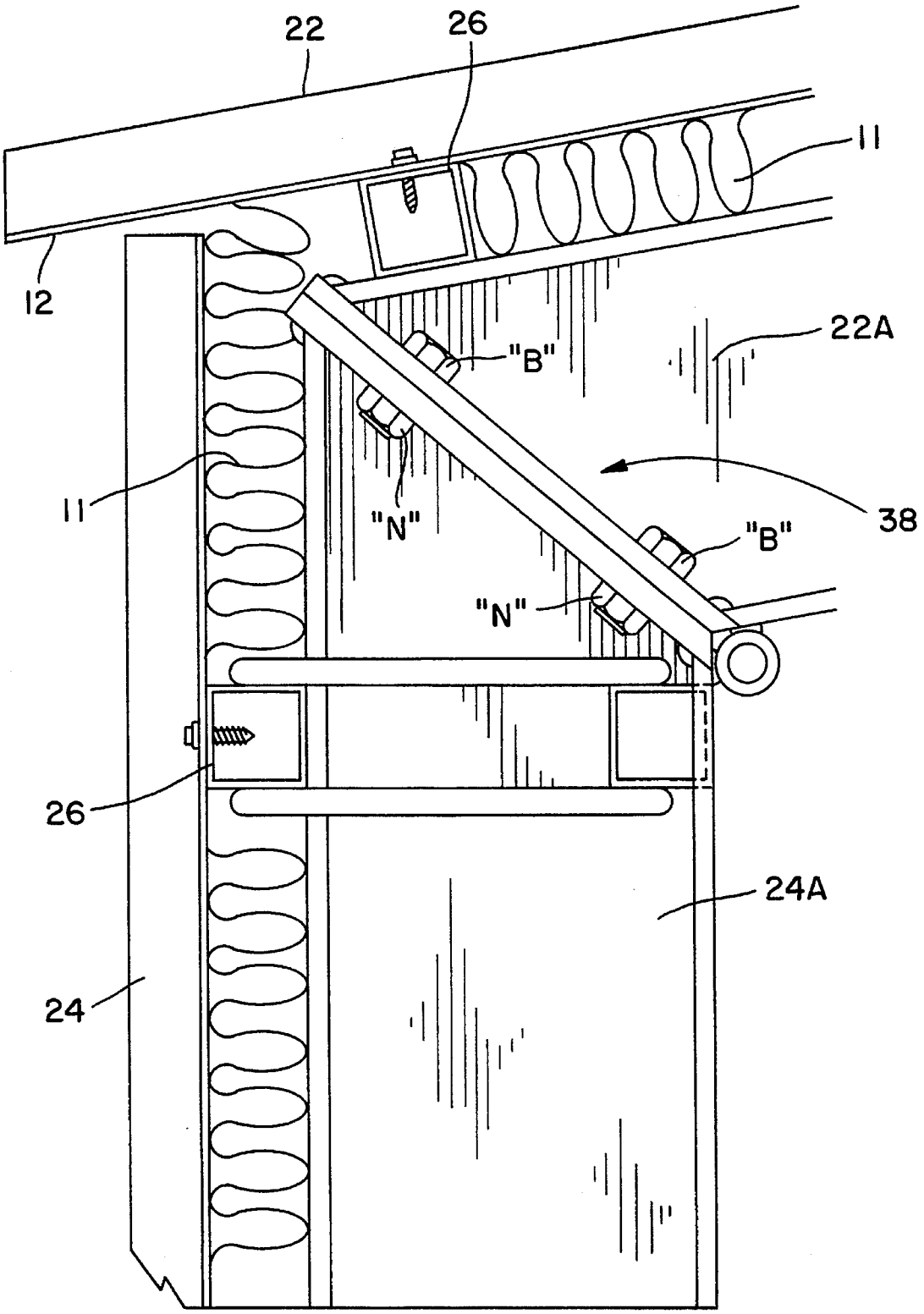
FIG. 6 is an enlarged, fragmentary view of an outer roof beam and an adjacent side beam, showing particularly the hinge assembly and connection between the two beams.

FIG. 6 illustrates the connection of a single side beam 24A of the side walls 24 and 25 to an outer roof beam 22A of the outer roof sections 22 and 23. The hinge assembly 38 and connection of the remaining side beams 24A&24B and 25A&25B to the outer roof beams 22A&22B and 23A&23B are identical to that shown in FIG. 6.

Figure 7:
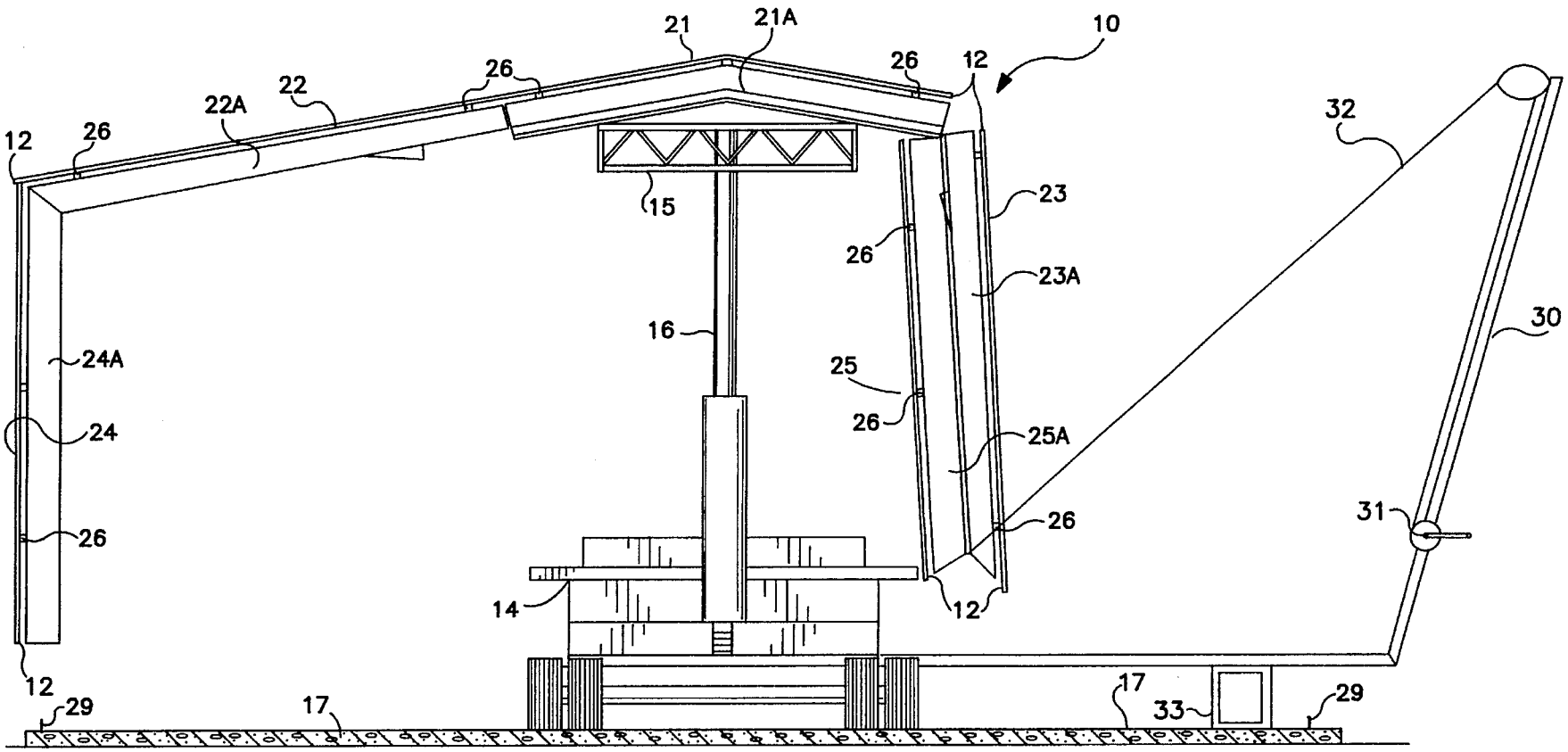
FIG. 7 is a front elevation of the foldable building showing the first half of building completely erected.
Figure 8:
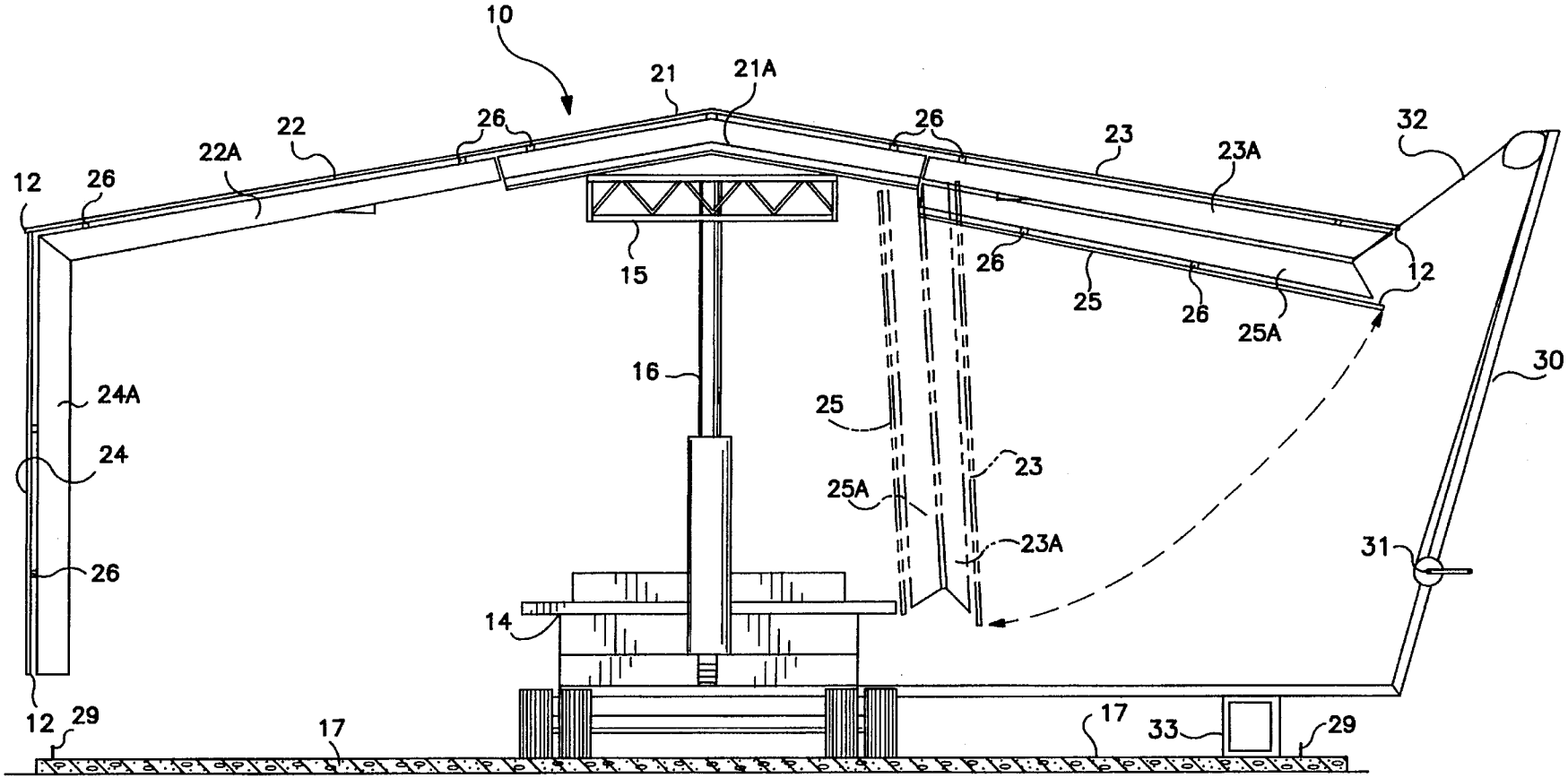
FIG. 8 is a front elevation of the foldable building showing the upward, pivoting movement of the second outer roof section into position in substantial alignment with the central roof section.
Figure 9:
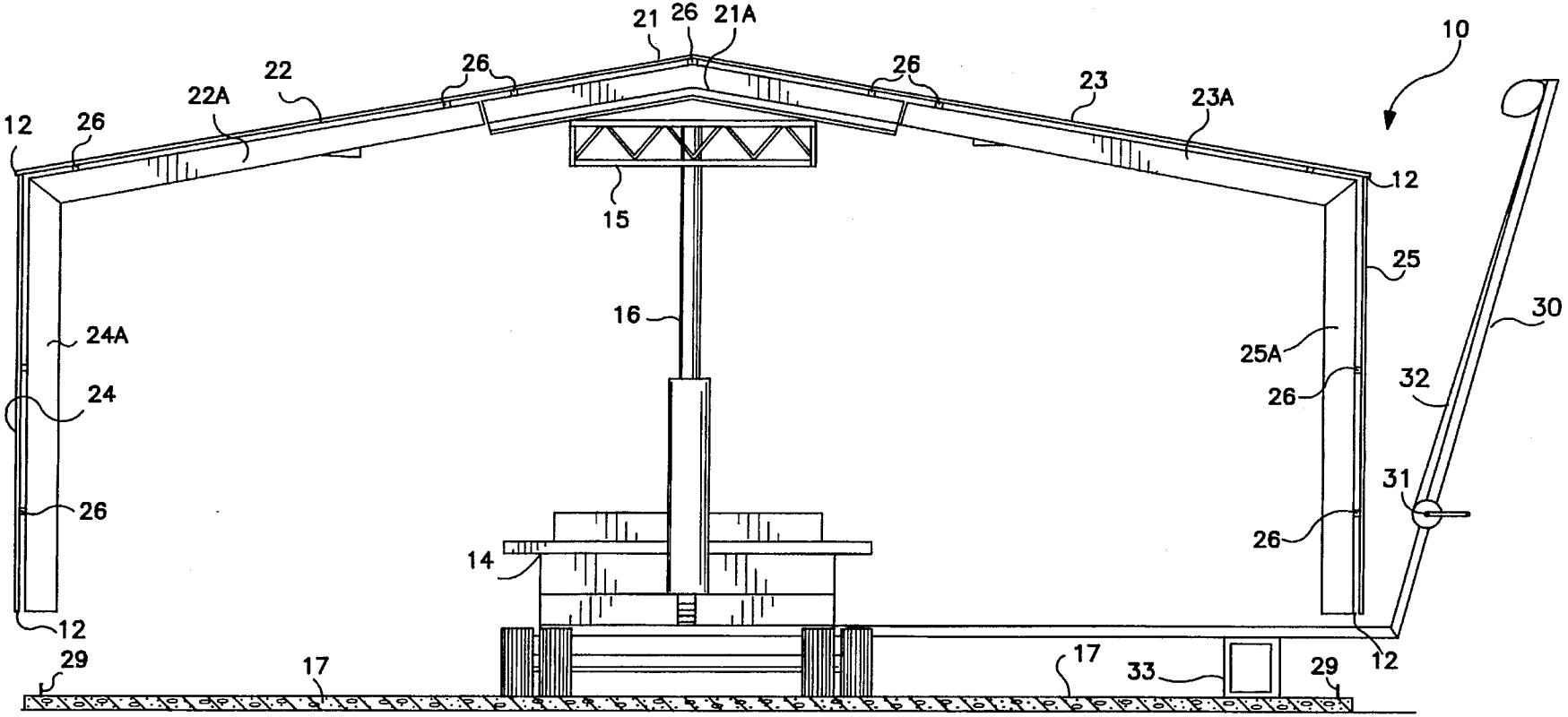
FIG. 9 is a front elevation of the foldable building showing the building in a completely erected condition.

Referring now to FIGS. 7, 8, and 9, the first half of the building 10 is shown erected and bolted together as described above, and the lifting arm 30 is shown on the opposite side of the trailer 14 in position to erect the second half of the building 10. As shown in FIG. 7, the hoist cable 32 is first attached to an edge of the second outer roof section 23. The second outer roof section 23 is then lifted upwardly into position. FIG. 8 illustrates the pivoting movement of the second outer roof section 23 from the lowered position to the raised position in alignment with the central roof section 21. When properly aligned, the outer roof beams 23A and 23B of the second outer roof section 23 are coupled, respectively, with the central roof beams 21A and 21B of the central roof section 21 by a plurality of threaded bolts "B" and nuts "N", or by welding. The connection of the outer roof beams 23A and 23B of second outer roof section 23 to the central roof beams 21A and 21B of the central roof section 21 is identical to that described above with reference to the first outer roof section 22.

Once the second outer roof section 23 has been secured in the raised position to the central roof section 21, the second side wall 25 is lowered into position. The side beams 25A and 25B of the second side wall 25 and the outer roof beams 23A and 23B of the second outer roof section 23 are connected together, respectively, in an identical manner described above with reference to the first side wall 22.

Figure 10:
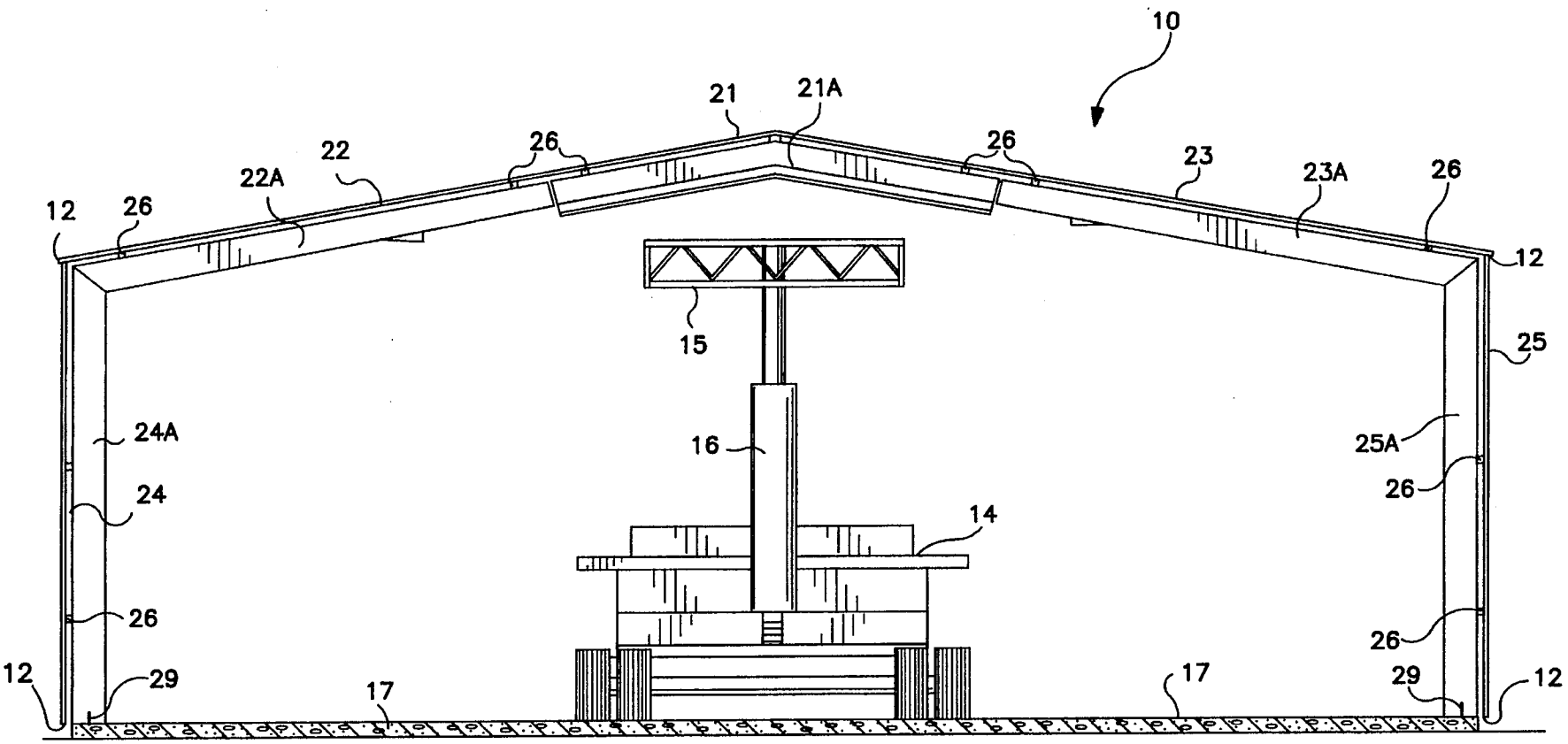
FIG. 10 is a front elevation of the foldable building showing the carriage in a lowered position, and the building mounted on the supporting foundation.

As shown in FIGS. 9 and 10, the building 10 is now completely erected and ready for mounting on the concrete foundation 17. The lifting arm 30 is removed from the trailer 14, and the carriage 15 is lowered by jacks 16 to place the erected building 10 onto the foundation 17. The brackets (not shown) on the base of the side walls 24 and 25 are aligned and mated with the plurality of anchor pins 29 projecting upwardly from the concrete foundation 17, as shown in FIG. 10. Preferably, bolts connect the brackets and anchor pins 29 together.

Figure 11:
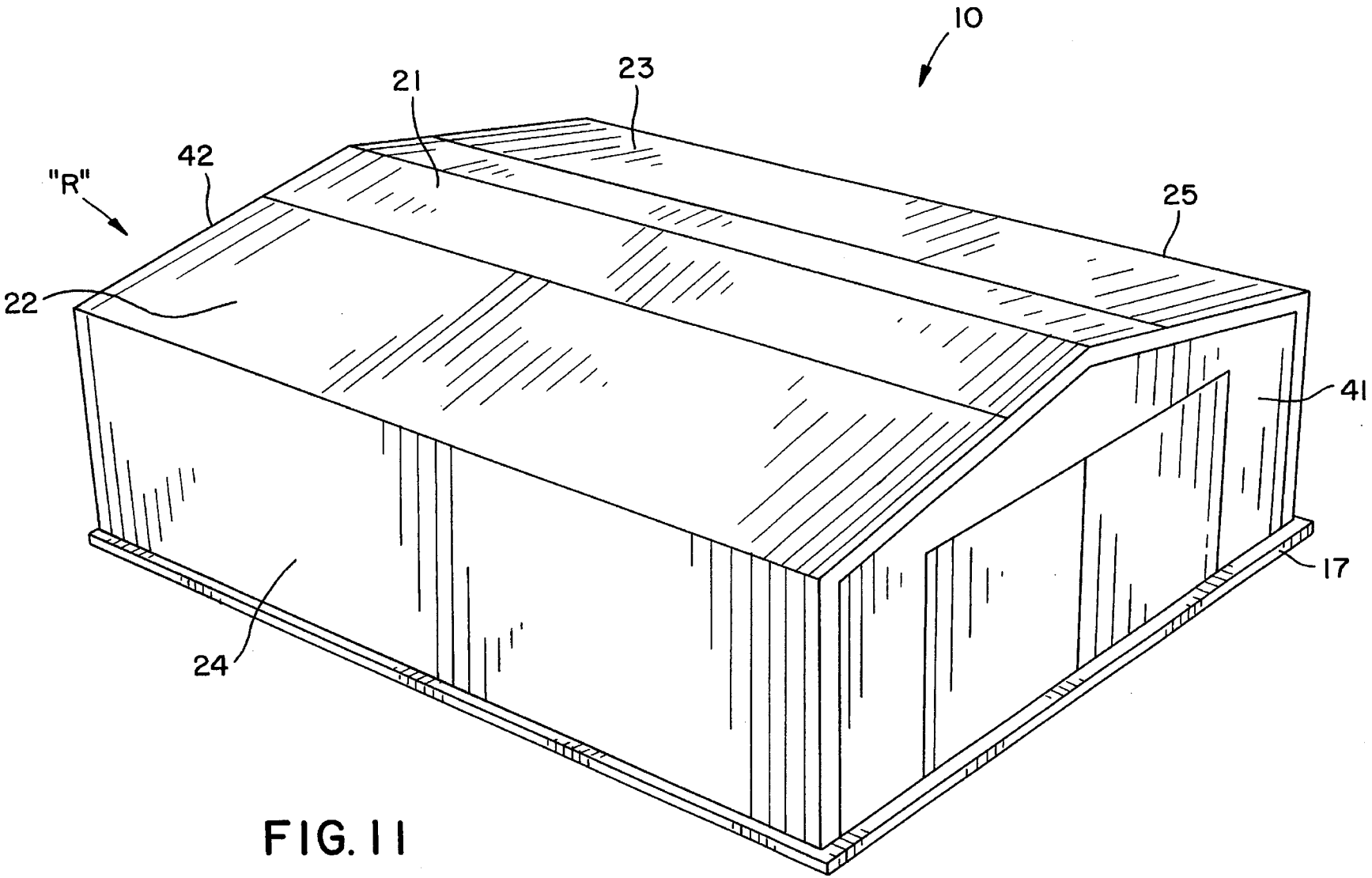
FIG. 11 is a perspective view of the building in an erected condition.
Figure 12:
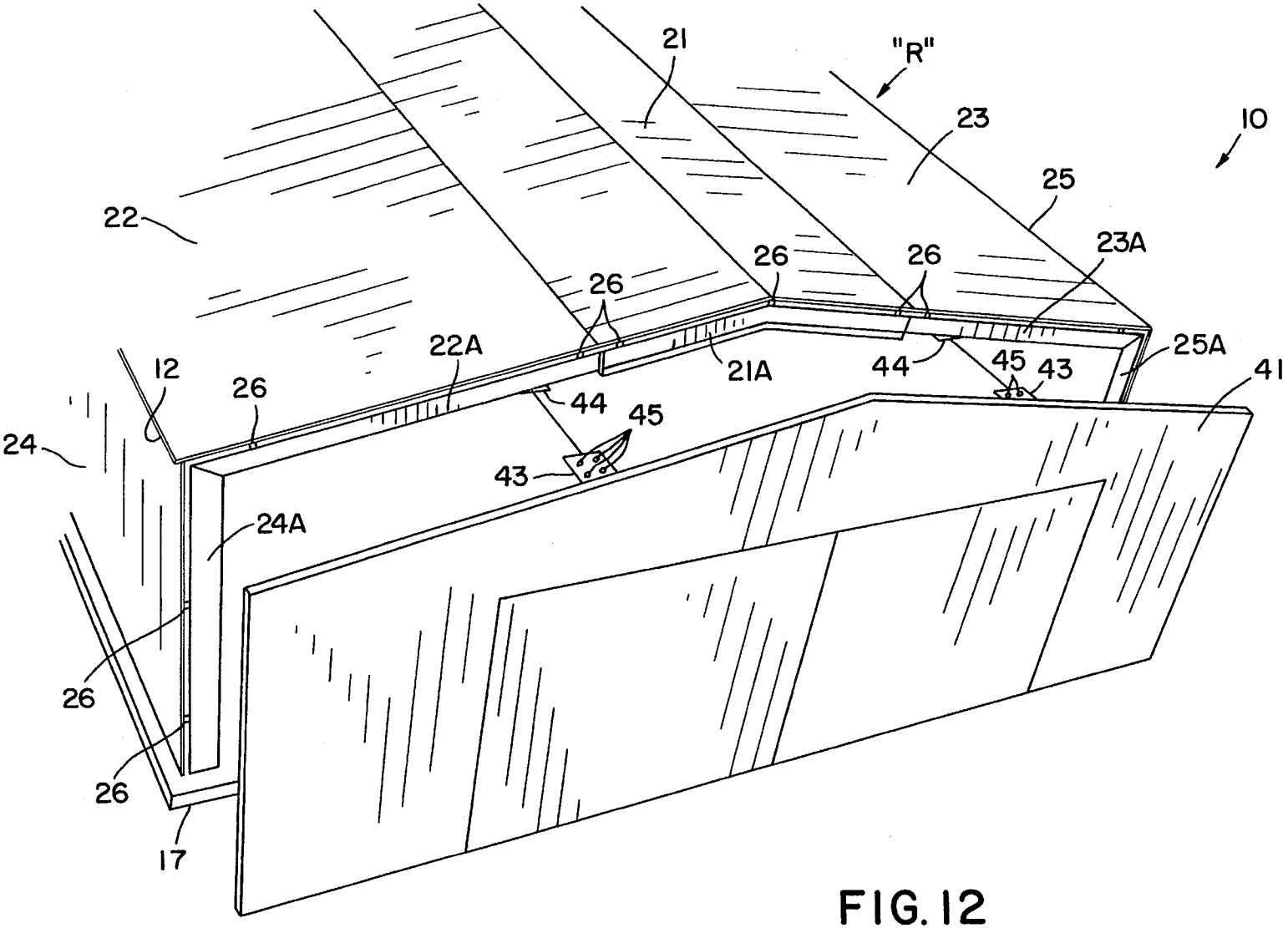
FIG. 12 is a perspective view of the building in an erected condition showing the attachment of the front wall to the building.
Figure 13:
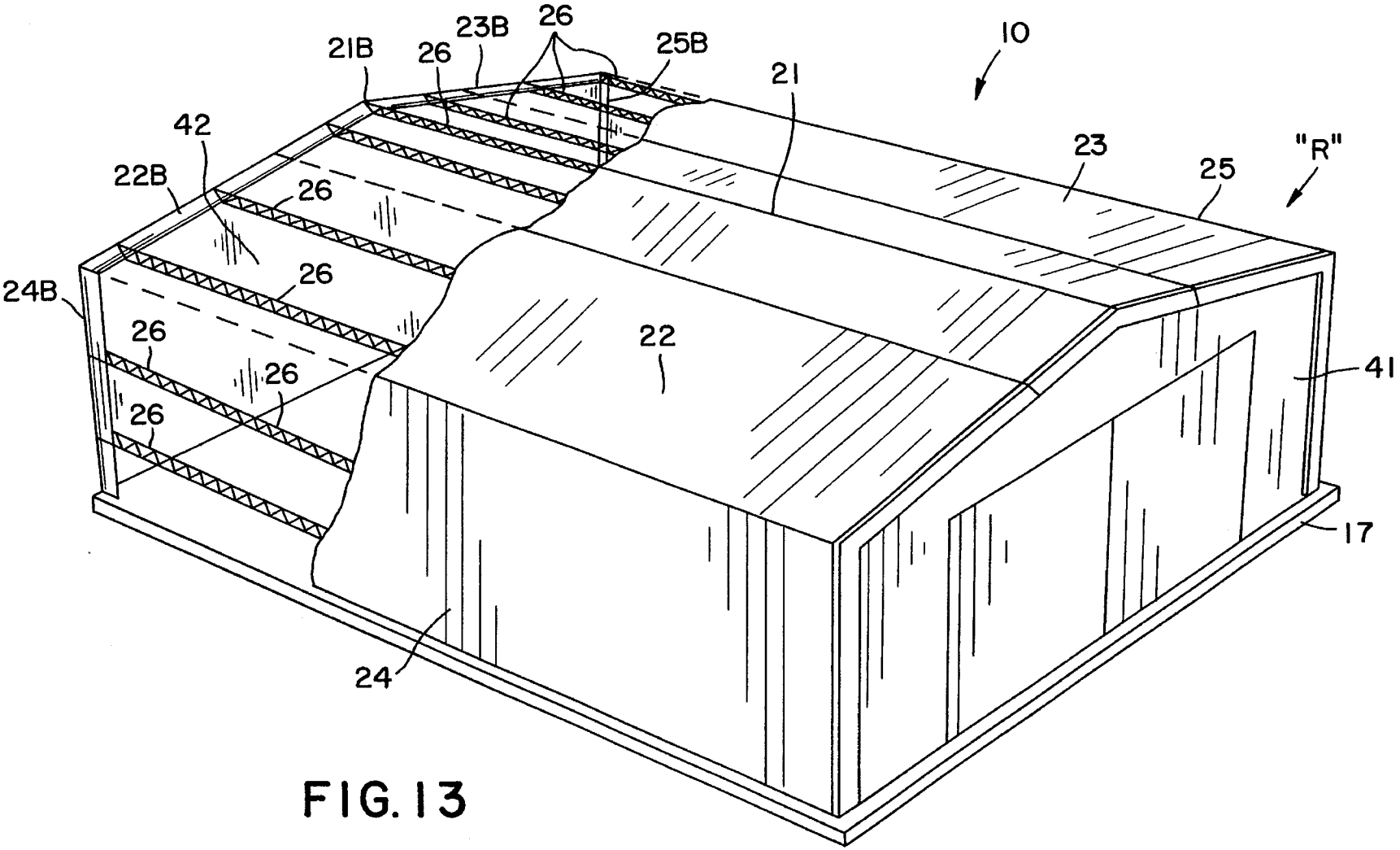
FIG. 13 is a perspective view of the building in an erected condition with a portion of the roof broken away to show the horizontal joists for interconnecting the opposing beams of the building.

Referring to FIGS. 11, 12, and 13, after the building 10 has been erected onto the supporting foundation 17 as described above, a separate front wall 41 and/or back wall 42 may be added to the building 10 for closure. As shown in FIG. 12, the front wall 41 preferably includes one or more connecting extensions 43 for being inserted into respective sleeves 44 formed on the outer roof beams 22A and 23A of the outer roof sections 22 and 23. Preferably, each extension 43 including a plurality of holes 45 for receiving a corresponding number of bolts (not shown). The bolts extend through the holes 45 and sleeves 44 for attaching the front wall 41 to the building 10. The back wall 42 is best shown in FIG. 13, and is preferably attached to the building 10 in an identical manner as the front wall 41.

Figure 14:
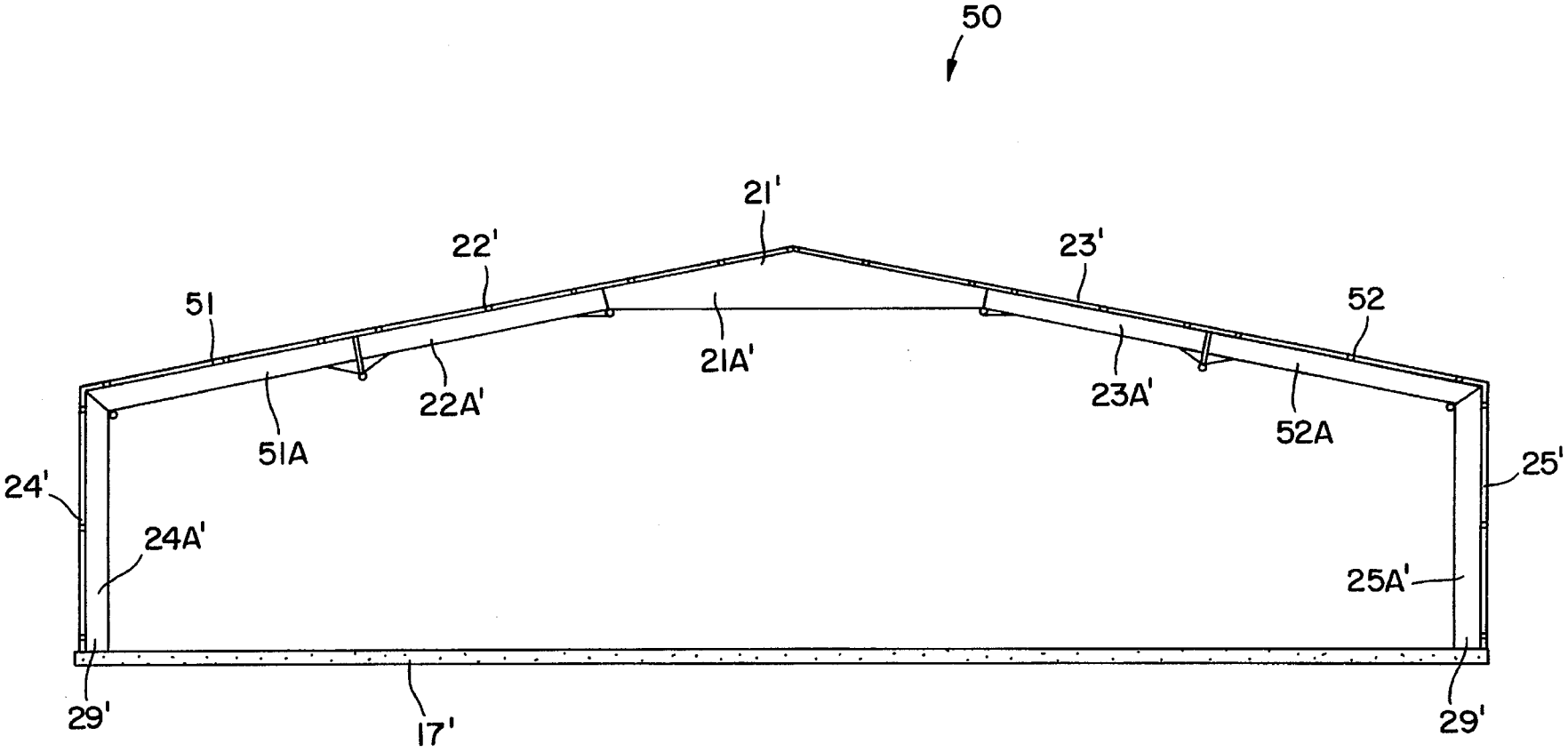
FIG. 14 is a front elevation of the building according to a second embodiment of the invention.
Figure 15:
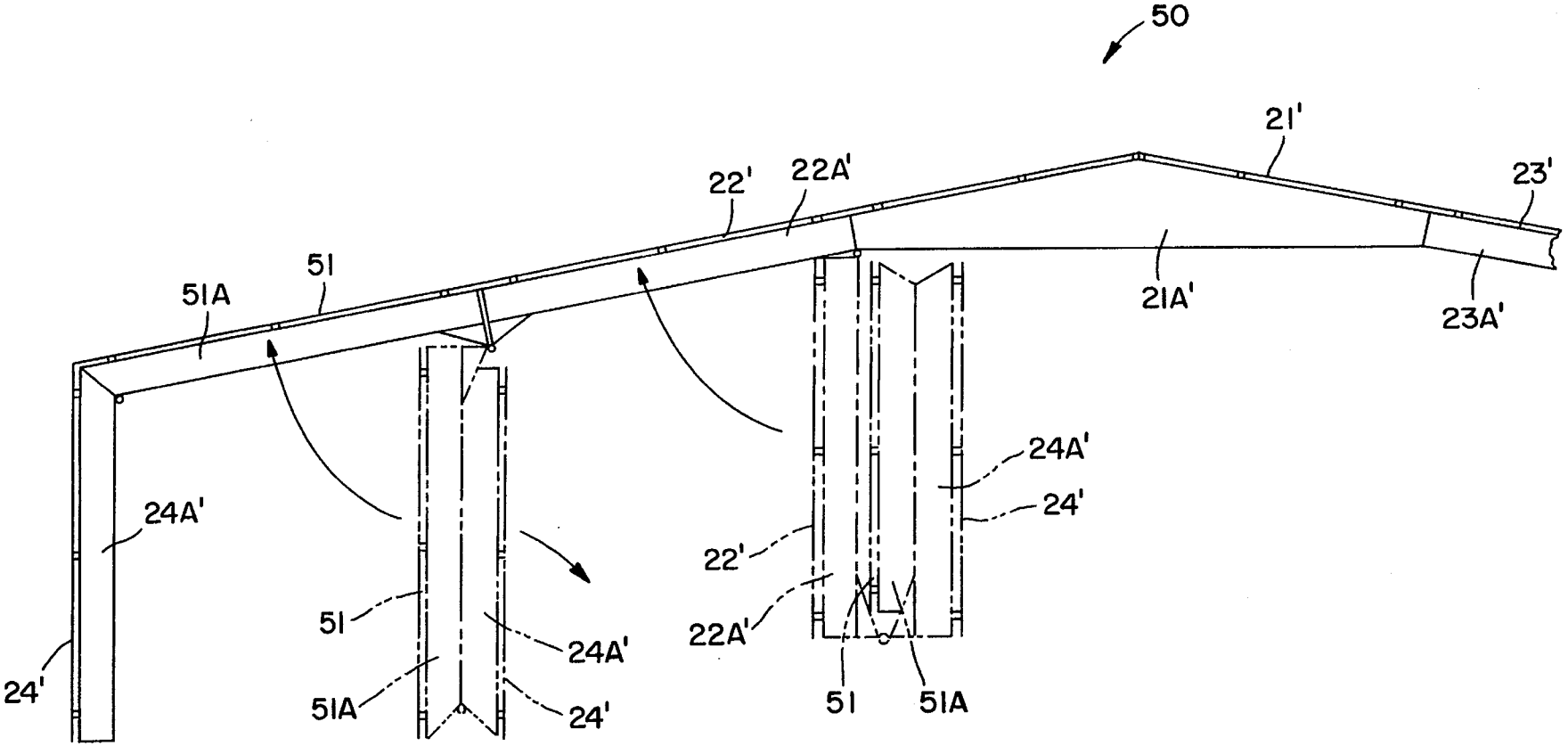
FIG. 15 is a front elevation of the building illustrated in FIG. 14, and showing in phantom the respective positions of the roof sections and side wall prior to and during unfolding.

A second embodiment of the invention is illustrated in FIGS. 14 and 15. Like elements previously discussed with regard to FIGS. 1–13 are referenced in prime notation. According to this embodiment, third and fourth outer roof sections 51 and 52 are included for providing a building 50 of greater dimensions, such as 50 ft.×50 ft. Each additional roof section 51 and 52 is constructed of opposing additional roof beams, 51A, 51B and 52A, 52B, only one of which is shown in FIGS. 14 and 15, and a plurality of horizontal joists (not shown) for interconnecting the opposing beams 51A, 51B and 52A, 52B.

When in a folded condition, the outer roof sections 22' and 23' and side walls 24' and 25' are positioned as described above with reference to the building 10. The additional roof sections 51 and 52 fold inwardly, as shown in FIG. 14, to reside adjacent the side walls 24' and 25'. Preferably, the additional roof sections 51 and 52, when folded, do not increase the width of the folded building 50. This allows easier transport of the building 50 from the prefabrication site to the pre-formed foundation 17.

To erect the building 50, the first outer roof section 22' is lifted and attached to the central roof section 21', as described above. The first side wall 24' and first additional roof section 51 are then pivoted downwardly towards the foundation 17'. The additional roof section 51 pivots upwardly, and is bolted or welded to the adjacent outer roof section 22'.

Once the additional roof sections 51 and 52 have been secured in the raised position to the outer roof sections 22' and 23', the side walls 24' and 25' are lowered and mounted onto the concrete foundation 17', as described above In addition, the building 50 may include both a front and back wall (not shown). The attachment of the front and back walls to the building would be identical to that described above with reference to the building 10.

A transportable, foldable building is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A transportable, foldable building for being mounted on a supporting foundation, said building comprising:

(a) a central roof section comprising a central roof beam for being supported in vertically spaced relation above the foundation;

(b) first and second outer roof sections comprising first and second outer roof beams pivotally attached to respective ends of the central roof beam, said first and second outer roof beams extending downwardly from said central roof beam during transport of said building and prior to erecting said building onto the supporting foundation to reduce the width of the building during transport;

(c) a first side wall comprising a first side beam pivotally attached to an end of the first outer roof beam and folded inwardly in overlying relation to the first outer roof beam during transport of said building and prior to erecting and mounting said building onto the supporting foundation; and (d) a second side wall comprising a second side beam pivotally attached to an end of the second outer roof beam and folded inwardly in overlying relation to the second outer roof beam during transport of said building and prior to erecting and mounting said building onto the supporting foundation;

whereby said building is erected onto the supporting foundation by vertically lifting and securing the first and second outer roof sections in alignment with the central roof section, and by unfolding said first and second side walls downwardly from respective first and second outer roof sections to the supporting foundation, said building being supportable entirely by said first and second side walls.

2. A building according to claim 1, wherein the central roof section includes first and second, opposing central roof beams laterally spaced-apart and located respectively at front and back ends of the roof of said building.

3. A building according to claim 2, wherein the first and second outer roof sections include respective pairs of opposing outer roof beams pivotally attached to the first and second central roof beams of the central roof section, said pairs of outer roof beams extending downwardly from said first and second central roof beams during transport of said building and prior to erecting said building onto the supporting foundation.

4. A building according to claim 3, and including respective hinge assemblies for pivotally attaching the pairs of outer roof beams of the first and second outer roof sections to the central roof beams of the central roof section.

5. A building according to claim 4, wherein each of said hinge assemblies includes coupling means for securing the outer roof beams of the first and second outer roof sections and the central roof beams of the central roof section to each other in an immovable condition to thereby define a rigid, fixed roof frame.

6. A building according to claim 5, wherein said coupling means comprises complementary pairs of threaded bolts and nuts.

7. A building according to claim 6, and including a plurality of horizontal joists interposed between the central roof beams of the central roof section and the pairs of outer roof beams of the first and second outer roof sections for supporting insulation and exterior siding.

8. A building according to claim 3, wherein the first and second side walls include respective pairs of opposing side beams pivotally attached to the pairs of outer roof beams of the first and second outer roof sections, the pairs of side beams being folded inwardly in overlying relation to the pairs of outer roof beams during transport of said building and prior to erecting and mounting said building on the supporting foundation.

9. A building according to claim 8, and including respective hinge assemblies for pivotally attaching the pairs of side beams of the first and second side walls to the pairs of outer roof beams of the first and second outer roof sections.

10. A building according to claim 9, wherein each of said hinge assemblies includes coupling means for securing the side beams of the first and second side walls and the outer roof beams of the first and second outer roof sections to each other in an immovable condition to thereby define opposing side wall frames for providing vertical support when said building is erected onto the foundation.

11. A building according to claim 10, wherein said coupling means comprises complementary pairs of threaded bolts and nuts.

12. A building according to claim 11, and including a plurality of horizontal joists interposed between respective pairs of side beams of the first and second side walls for supporting insulation and exterior siding.

13. A building according to claim 1, and including front and back walls for being attached to said building after said building is erected onto the supporting foundation.

14. A building according to claim 13, wherein the front and back walls each include a connecting extension for mating with a complementary sleeve formed on respective front and back ends of the sections to connect the front wall to a front end of the building and the back wall to a back end of the building.

15. In combination with a foldable building according to claim 1, a building transport and erection assembly comprising:

(a) a trailer for transporting said building in a folded condition from a building prefabrication site to a building erection site; and (b) a carriage mounted on said trailer for carrying and supporting said building prior to and during erection of said building onto the foundation.

16. A building transport and erection assembly according to claim 15, and further comprising at least one adjustable jack mounted on said trailer and interposed between said carriage and said trailer for vertically adjusting the height of said carriage to lift or lower said building prior to erecting said building onto the foundation.

17. A building transport and erection assembly according to claim 15, and further comprising a liftings arm for being removably attached to said trailer to lift the outer roof sections and side walls of said building into their respective erected positions during erection of said building onto the foundation.

18. A building transport and erection assembly according to claim 17, wherein said lifting arm includes a hoist cable for being attached at one end to an edge of one of the first and second outer roof sections, and winch for retracting said cable to pivot the one of said first and second outer roof sections upwardly into an erected position.

19. A transportable, foldable building to be mounted on a supporting foundation, said building comprising:

(a) a central roof section comprising a central roof beam for being supported in vertically spaced relation above the foundation;

(b) first and second outer roof sections comprising first and second outer roof beams pivotally attached to respective ends of the central roof beam, said first and second outer roof beams extending downwardly from said central roof beam during transport of said building and prior to erecting said building onto the supporting foundation to reduce the width of the building during transport;

(c) third and fourth outer roof sections comprising third and fourth outer roof beams pivotally attached to respective ends of the first and second outer roof beams, and folded upwardly and inwardly in overlying relation to the first and second outer roof beams during transport of said building and prior to erecting and mounting said building onto the supporting foundation; and (d) first and second side walls comprising first and second side beams pivotally attached to respective ends of the third and fourth outer roof beams, and folded downwardly and outwardly in overlying relation to the third and fourth outer roof beams during transport of said building and prior to erecting and mounting said building onto the supporting foundation, whereby said building is supportable entirely by said first and second side walls.

20. A method of erecting a transportable and foldable building onto a supporting foundation, comprising the steps of:

(a) locating a central roof beam of a central roof section in vertically spaced relation above the supporting foundation;

(b) pivotally attaching first and second outer roof beams of first and second outer root sections to respective ends of the central roof beam to extend downwardly from the central roof beam during transport of the building and prior to erecting the building onto the supporting foundation to reduce the width of the building during transport;

(c) pivotally attaching first and second side beams of first and second side walls to respective ends of the first and second outer roof beams, the first and second side beams being folded upwardly and inwardly in overlying relation to the first and second outer roof beams during transport of said building and prior to erecting and mounting said building onto the supporting foundation;

(d) lifting the first and second outer roof beams of the first and second outer roof sections from a lowered position to a raised position into alignment with the central roof beam of the central roof section to define a roof of said building; and pivoting the first and second side beams of the first and second side walls downwardly from a position adjacent the first and second outer roof beams of the first and second outer roof sections to the supporting foundation, whereby said building is supportable entirely by said first and second side walls.

21. A method according to claim 20, wherein the step of locating the central roof section above the foundation includes the step of providing a trailer and carriage for supporting said building prior to and during erecting onto the supporting foundation.

22. A method according to claim 21, wherein the step of locating the central roof section above the foundation further includes the step of providing a least one adjustable jack mounted on said trailer and interposed between said trailer and said carriage for vertically adjusting the height of said carriage to lift or lower said building prior to erecting said building onto the foundation.

23. A method according to claim 21, wherein the step of lifting said first and second outer roof sections includes the step of attaching a lifting arm to the trailer for individually lifting each of the first and second outer roof sections into alignment with the central roof section.

* * * * *